US011205859B2

(12) United States Patent
Segador Alvarez et al.

(10) Patent No.: US 11,205,859 B2
(45) Date of Patent: Dec. 21, 2021

(54) DUAL-POLARIZED RADIATING ELEMENT AND ANTENNA

(71) Applicant: Huawei Technologies Co., Ltd., Shenzhen (CN)

(72) Inventors: Juan Segador Alvarez, Munich (DE); Tao Tang, Dongguan (CN); Bruno Biscontini, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/673,430

(22) Filed: Nov. 4, 2019

(65) Prior Publication Data

US 2020/0067205 A1 Feb. 27, 2020

Related U.S. Application Data

(63) Continuation of application No. PCT/EP2017/060689, filed on May 4, 2017.

(51) Int. Cl.
*H01Q 21/26* (2006.01)
*H01Q 5/307* (2015.01)
(Continued)

(52) U.S. Cl.
CPC ..... *H01Q 21/26* (2013.01); *H01Q 5/307* (2015.01); *H01Q 9/26* (2013.01); *H01Q 21/0006* (2013.01); *H01Q 1/243* (2013.01); *H01Q 1/246* (2013.01); *H01Q 19/08* (2013.01); *H01Q 21/062* (2013.01); *H01Q 21/30* (2013.01)

(58) Field of Classification Search
CPC ..... H01Q 21/26; H01Q 21/30; H01Q 21/062; H01Q 19/108; H01Q 1/243; H01Q 21/065
See application file for complete search history.

(56) References Cited

U.S. PATENT DOCUMENTS 2,976,534 A * 3/1961 Kampinsky ..... H01Q 21/22 343/756
2008/0284656 A1 11/2008 Petropoulos
(Continued)

FOREIGN PATENT DOCUMENTS

CN 1688067 A 10/2005
CN 201018007 Y 2/2008
(Continued)

OTHER PUBLICATIONS

CN/201780090402.7, Notice of Allowance/Search Report, dated Feb. 4, 2021.

*Primary Examiner* — Joseph J Lauture
(74) *Attorney, Agent, or Firm* — Leydig, Voit & Mayer, Ltd.

(57) ABSTRACT

The present disclosure provides a dual-polarized radiating element comprising a feeding arrangement and four dipole arms. The feeding arrangement comprises four slots, which extend from a periphery towards a center of the feeding arrangement and are arranged at regular angular intervals forming a first angular arrangement. The four dipole arms extend outwards from the feeding arrangement and are arranged at regular angular intervals forming a second angular arrangement. The second angular arrangement of the four dipole arms is rotated with respect to the first angular arrangement of the four slots.

19 Claims, 15 Drawing Sheets

(51) Int. Cl.

| | |
|---|---|
| ***H01Q 9/26*** | (2006.01) |
| ***H01Q 21/00*** | (2006.01) |
| *H01Q 1/24* | (2006.01) |
| *H01Q 21/30* | (2006.01) |
| *H01Q 19/08* | (2006.01) |
| *H01Q 21/06* | (2006.01) |

(56) References Cited

U.S. PATENT DOCUMENTS

| | | | | |
|---|---|---|---|---|
| 2012/0068892 | A1 | 3/2012 | Shtrom et al. | |
| 2016/0164190 | A1 | 6/2016 | Daurer et al. | |
| 2018/0034156 | A1* | 2/2018 | Zhang | H01Q 9/0414 |
| 2020/0212598 | A1* | 7/2020 | Gonzalez | H01Q 25/001 |

FOREIGN PATENT DOCUMENTS

| | | | |
|---|---|---|---|
| CN | 102496777 | A | 6/2012 |
| CN | 102544764 | A | 7/2012 |
| CN | 103474755 | A | 12/2013 |
| CN | 203434269 | U | 2/2014 |
| CN | 204029994 | U | 12/2014 |
| CN | 104300233 | A | 1/2015 |
| CN | 105393406 | A | 3/2016 |
| CN | 106159464 | A | 11/2016 |
| CN | 106233532 | A | 12/2016 |
| EP | 0149922 | B1 | 7/1988 |
| EP | 2757633 | A1 | 7/2014 |
| FR | 2953652 | A1 | 6/2011 |
| JP | 2008515253 | A | 5/2008 |
| JP | 2015507382 | A | 3/2015 |
| JP | 2016534598 | A | 11/2016 |
| KR | 20160000770 | A | 1/2016 |
| WO | 2014062513 | A1 | 4/2014 |
| WO | 2015124573 | A1 | 8/2015 |
| WO | 2015168845 | A1 | 11/2015 |
| WO | 2016081036 | A1 | 5/2016 |
| WO | 2016204821 | A1 | 12/2016 |

* cited by examiner

DUAL-POLARIZED RADIATING ELEMENT AND ANTENNA

CROSS-REFERENCE TO RELATED APPLICATIONS

This application is a continuation of International Application No. PCT/EP2017/060689, filed on May 4, 2017, the disclosure of which is hereby incorporated by reference in its entirety.

TECHNICAL FIELD

The present disclosure relates to a dual-polarized radiating element for an antenna, i.e. to a radiating element configured to emit radiation of two different polarizations. The present disclosure relates further to an antenna, specifically to a multiband antenna comprising at least one dual-polarized radiating element according to the present disclosure, and preferably one or more other radiating elements.

BACKGROUND

With the deployment of long-term evolution (LTE) systems, network operators are adding new spectrum to networks, in order to increase their network capacity. To this end, antenna vendors are encouraged to develop new antennas with more antenna ports/arrays and supporting further frequency bands, without increasing the antenna size.

For instance, multiple-input multiple-output (MIMO) requirements in the current LTE standard require a duplication of the number of antenna ports/arrays, at least in higher frequency bands (HBs). In particular, to exploit all capabilities of the current LTE standard, new antennas should necessarily support 4×4 MIMO in the HBs. Additionally, in order to be ready for future deployments, MIMO support is also desired in lower frequency bands (LBs).

At the same time, there is a growing demand for a deeper integration of antennas with active antenna systems (AAS). This integration leads to highly complex systems, and thus strongly influences the antenna form factor, since it is fundamental for commercial field deployment. One of the dominant limiting factors in this context is the antenna height. Reducing the antenna height for new antennas would mean a significant simplification of the overall deployment process of an AAS or of a traditional passive antenna system.

Additionally, in order to facilitate site acquisition, and to fulfill local regulations regarding site upgrades, also the antenna width of new antennas should be at least comparable to legacy products. In particular, to maintain the mechanical support structures already existing in the sites, specifically the wind load of new antennas should be equivalent to the ones of legacy products.

All the above factors lead to very strict limitations in antenna height and width for the new antennas, despite of the requirement for more antenna ports/arrays and for further frequency bands. Furthermore, despite of these size limitations, radio frequency (RF) performance of new antennas should also be equivalent to legacy products, in order to maintain (or even improve) the coverage area and network performance.

Specifically, when considering the performance of a radiating element included in an antenna, a reduction of the antenna height naturally implies also a reduction of the radiating element, and would lead to a reduction in the relative bandwidth that can be covered with an acceptable RF performance. Thus, in order to at least cover the standard operating bands in base station antenna systems, and to at least maintain the same RF performance, with a reduced antenna height, requires new concepts for radiating elements different from the legacy technology.

In order to meet the above-mentioned requirements for 4×4 MIMO, especially the number of HB arrays in the same antenna aperture must practically be duplicated. In order to meet also the above-mentioned size limitations, particularly regarding antenna width, these HB arrays should be placed closer to each other than in legacy antenna architectures. To this end, new concepts for especially LB radiating elements are needed, specifically ones that can coexist with tightly spaced HB arrays.

Conventional LB radiating elements are not sufficient to meet the above-mentioned requirements. Conventional LB radiating elements are either not shaped such that they can be used in multiband antenna architectures with very tightly spaced HB arrays, or they are not optimized with respect to antenna height and operating bandwidth, respectively.

SUMMARY

In view of the above-mentioned challenges and disadvantages, the present disclosure aims to improve conventional radiating LB elements and conventional multiband antennas. In particular, the present disclosure has the object to provide a radiating element that has broadband characteristics, but is at the same time low profile. In addition, the radiating element should have a shape that allows minimum spacing between two HB arrays in a multiband antenna. In particular, the radiating element should allow maximized utilization of the available space in the multiband antenna aperture. Further, the shadow of the radiating element on the HB array should be minimized.

Notably, broadband characteristics here means a relative bandwidth of larger than 30%. Low profile means that the antenna height is smaller than 0.15λ, wherein λ is the wavelength at the lowest frequency of the frequency band of the operating radiating element.

The object of the present disclosure is achieved by the solutions provided in the enclosed independent claims. Advantageous implementations of the present disclosure are further defined in the dependent claims.

The main idea of the present disclosure is combining, in the provided radiating element, a dipole feeding concept, in order to provide broadband characteristics, with a radiating element shape, which is optimized to work in a multiband antenna together with tightly spaced HB arrays.

A first aspect of the present disclosure provides a dual-polarized radiating element, comprising a feeding arrangement comprising four slots, which extend from a periphery towards a center of the feeding arrangement and are arranged at regular angular intervals forming a first angular arrangement, and four dipole arms, which extend outwards from the feeding arrangement and are arranged at regular angular intervals forming a second angular arrangement, wherein the second angular arrangement of the four dipole arms is rotated with respect to the first angular arrangement of the four slots.

The mentioned rotation is around an axis of rotation perpendicular to the extension directions of the slots and dipole arms. The axis extends through a middle of the dual polarized radiating element, from a bottom to the top of the dual polarized radiating element.

The feeding arrangement including the four slots provides the radiating element with the desired broadband characteristics. The shape of the radiating element, in particular the angular arrangements of the dipole arms and the slots, respectively, which are rotated with respect to another, provides the radiating element with the desired shape that is optimized to work in a multiband antennas together with very tightly spaced HB arrays. In particular, the shape of the radiating element minimizes its interference with higher frequency radiating elements arranged side-by-side on the same multiband antenna. This consequently allows minimizing a distance between different arrays of those higher frequency radiating elements. Particularly, the radiating element fulfils the above-mentioned conditions that it is firstly low profile, but is secondly provided with broadband characteristics.

In a first implementation form of the first aspect, the four slots and the four dipole arms, respectively, are arranged at 90 degrees (°) intervals, and the second angular arrangement of the four dipole arms is rotated by 45° with respect to the first angular arrangement of the four slots. The mentioned intervals can include a manufacturing tolerance interval, e.g. ±5° or even only ±2°.

The radiating element can thus be arranged on an antenna such that its two emitted radiation polarizations are rotated by 45° with respect to a longitudinal axis of the antenna. Nevertheless, the dipole arms of the radiating element are arranged such that two of the dipole arms extend in line with the longitudinal axis of the antenna, while two of the dipole arms extend laterally at a 90° angle with respect to this axis. This orientation of the dipole arms allows arranging the radiating element between tightly spaced HB arrays, wherein the laterally extending dipole arms extend between other radiating elements in these HB arrays.

In a further implementation form of the first aspect, adjacently arranged slots extend perpendicular to another, non-adjacently arranged slots extend in line with another and the two in-line extending slot pairs define the two orthogonal polarizations of the dual-polarized radiating element.

In a further implementation form of the first aspect, each slot is terminated at its inner end by a symmetrically bent slot, preferably by a U-shaped slot.

The purpose of the symmetrically bent slots is extending the total length of each slot for impedance matching purposes. Since typically the slot length cannot be extended any more towards the center of the feeding arrangement, it is instead extended in a bent manner, for instance, by leading the symmetrically bent slots backwards in direction of the periphery of the feeding element.

In a further implementation form of the first aspect, at least a part of each dipole arm extends upwards and/or downwards with respect to the feeding arrangement plane. In the present disclosure, the feeding arrangement plane is a plane crossing all slots or having all slots lying in it and being perpendicular to the axis of rotation around which the second angular arrangement is rotated with respect to the first angular arrangement.

Thereby, the dipole arms can become electrically longer, without increasing their footprint. Additionally, due to an increased distance to ground, the capacitance to ground can be reduced, which allows increasing the working bandwidth.

In a further implementation form of the first aspect, each dipole arm is terminated at its outer end by a flap, particularly by a flap bent downwards or upwards with respect to the feeding arrangement plane and optionally bent back towards the feeding arrangement.

The flaps make the dipole arms of the radiating element electrically longer, without increasing their footprint.

In a further implementation form of the first aspect, the radiating element further comprises a parasitic director arranged above the feeding arrangement.

The parasitic director can be utilized to achieve the desired bandwidth, and thus to minimize the size of the radiating element.

In a further implementation form of the first aspect, the parasitic director extends outwards from the feeding arrangement less than each of the four dipole arms, and/or each dipole arm comprises an outer part extending upwards with respect to the feeding arrangement plane, and the parasitic director is arranged in a recess defined within the four outer parts.

Accordingly, the size of the radiating element, especially its width and height, are kept as small as possible.

In a further implementation form of the first aspect, the feeding arrangement comprises four transmission lines, each transmission line crossing one of the four slots.

The four transmission lines are preferably short-ended microstrip lines, which feed the four slots.

In a further implementation form of the first aspect, two transmission lines crossing non-adjacent slots are combined into one transmission line.

Thus, a symmetrical feeding of non-adjacent slots by a common transmission line is enabled. Accordingly, the radiating element can be operated to emit radiation of two polarization directions.

In a further implementation form of the first aspect, the feeding arrangement comprises a printed circuit board (PCB), on which PCB the four transmission lines are combined into the two transmission lines, or the radiating element comprises a PCB arrangement extending from a bottom surface of the feeding arrangement, on which PCB arrangement the four transmission lines are combined into the two transmission lines.

In a further implementation form of the first aspect, the feeding arrangement comprises a PCB, on which the four slots are arranged into which the four dipole arms are connected.

In a further implementation form of the first aspect, the feeding arrangement further comprises a metal sheet, wherein the four slots are cutouts in the metal sheet and also the four dipole arms are formed by the metal sheet.

The advantage of this implementation form is that additional flaps can be provided at the feeding arrangement. A PCB may be placed underneath the feeding arrangement in this implementation form.

In a further implementation form of the first aspect, the metal sheet comprises four flaps, which are bent upwards or downwards with respect to the feeding arrangement plane and are arranged in between the four dipole arms, respectively.

The additional flaps help optimizing the performance of the radiating element, by introducing a further degree of freedom for the feeding arrangement shape. In particular, the radiating element can be optimized to work together with higher frequency radiating elements, which are arranged close when deployed in a multiband antenna.

A second aspect of the present disclosure provides an antenna, comprising at least one dual-polarized radiation element according to the first aspect as such or any implementation form of the first aspect, wherein two dipole arms of the at least one dual-polarized radiating element extend along a longitudinal axis of the antenna, and two dipole arms of the at least one dual-polarized radiating element extend along a lateral axis of the antenna.

Due to the shape of the radiating element, and the specific arrangement of the one or more radiating elements on the antenna, a distance of the radiating elements to HB arrays can be minimized. Therefore, either the total width of the antenna can be minimized, or the number of HB arrays can be increased within an unchanged antenna width.

In an implementation form of the second aspect, each slot of the at least one dual-polarized radiating element extends at an angle of 45° with respect to the longitudinal axis of the antenna.

Thus, 45° polarizations of the emitted radiation are obtained, as required in current antenna specifications.

In a further implementation form of the second aspect, the antenna comprises a plurality of dual-polarized radiating elements arranged along the longitudinal axis of the antenna in a first column, and a plurality of other radiating elements arranged along the longitudinal axis of the antenna in two second columns disposed side by side the first column, wherein the dipole arms of the dual-polarized radiating elements extend between the other radiating elements in the two second columns.

In this way, the arrangement of the three columns can be made as dense as possible, so that the overall antenna width can be minimized.

In a further implementation form of the second aspect, the antenna is configured for multiband operation, and the dual-polarized radiating elements are configured to radiate in an LB and the other radiating elements are configured to radiate in an HB.

That is, the radiating element is designed for working in an LB array. In this antenna, interference and shadowing on the HB radiating elements in HB arrays can be minimized.

It has to be noted that all devices, elements, units and means described in the present application could be implemented in the software or hardware elements or any kind of combination thereof. All steps which are performed by the various entities described in the present application as well as the functionalities described to be performed by the various entities are intended to mean that the respective entity is adapted to or configured to perform the respective steps and functionalities. Even if, in the following description of specific embodiments, a specific functionality or step to be performed by external entities is not reflected in the description of a specific detailed element of that entity which performs that specific step or functionality, it should be clear for a skilled person that these methods and functionalities can be implemented in respective software or hardware elements, or any kind of combination thereof.

BRIEF DESCRIPTION OF DRAWINGS

The above-described aspects and implementation forms of the present disclosure will be explained in the following description of specific embodiments in relation to the enclosed drawings in which.

DETAILED DESCRIPTION OF EMBODIMENTS

Figure 1:
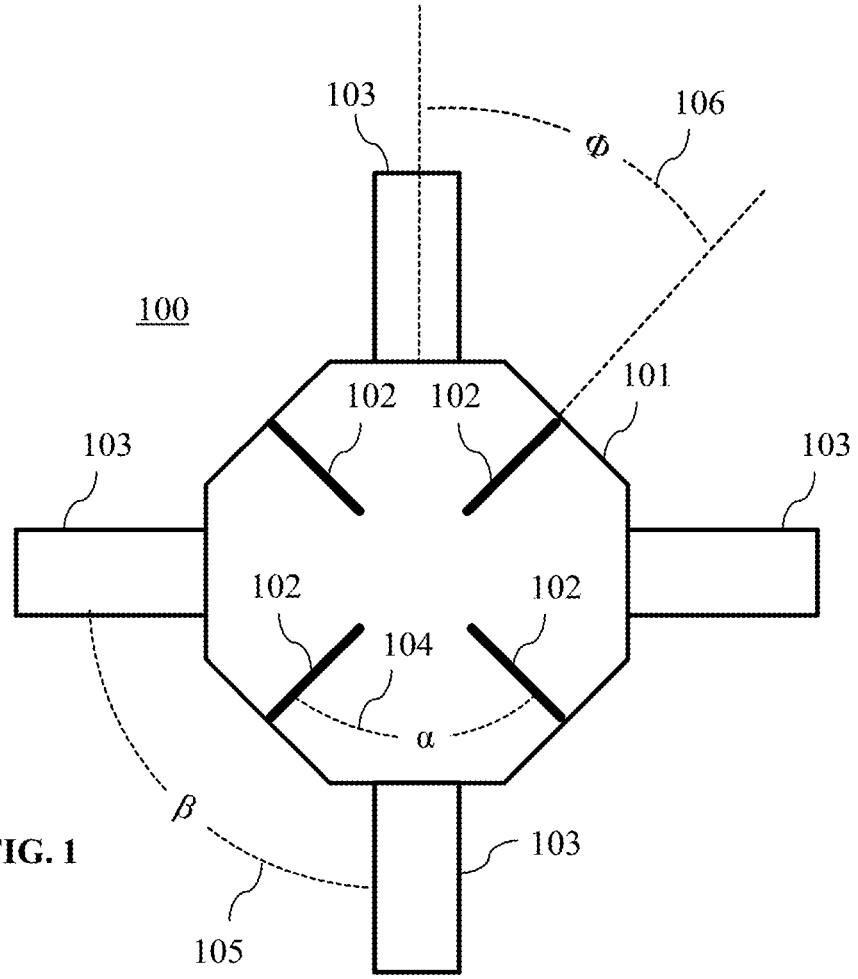
FIG. 1 shows a radiating element according to an embodiment of the present disclosure.

FIG. 1 shows a dual-polarized radiating element 100 according to an embodiment of the present disclosure. The radiating element 100 comprises a feeding arrangement 101, and four dipole arms 103. It further exhibits a specific angular arrangement of its components.

The feeding arrangement 101 comprises four slots 102, which extend from a periphery towards a center of the feeding arrangement 101, and are arranged at regular angular intervals 104, which forms a first angular arrangement. In particular, two adjacent slots 102 in the first angular arrangement are arranged with an angle $\alpha$ in between. Further, each of the slots 102 extends from the periphery of the feeding arrangement 101 to a center portion of the feeding arrangement 101, preferably in a radial manner.

The four dipole arms 103 extend outwards from the feeding arrangement 101, and are arranged at regular angular intervals 105, which forms a second angular arrangement. In particular, two adjacent dipole arms 103 in the second angular arrangement are arranged with an angle $\beta$ in between. A dipole arm 103 is a structural element extending from the feeding arrangement 101, with a length in extension direction that is larger than its width. Preferably, each of the dipole arms 103 has further a width that is smaller than the width of the feeding arrangement 101 side, from which it extends.

The second angular arrangement of the four dipole arms 103 is rotated 106 with respect to the first angular arrangement of the four slots 102, particularly by an angle $\Phi$ 106.

Figure 2:
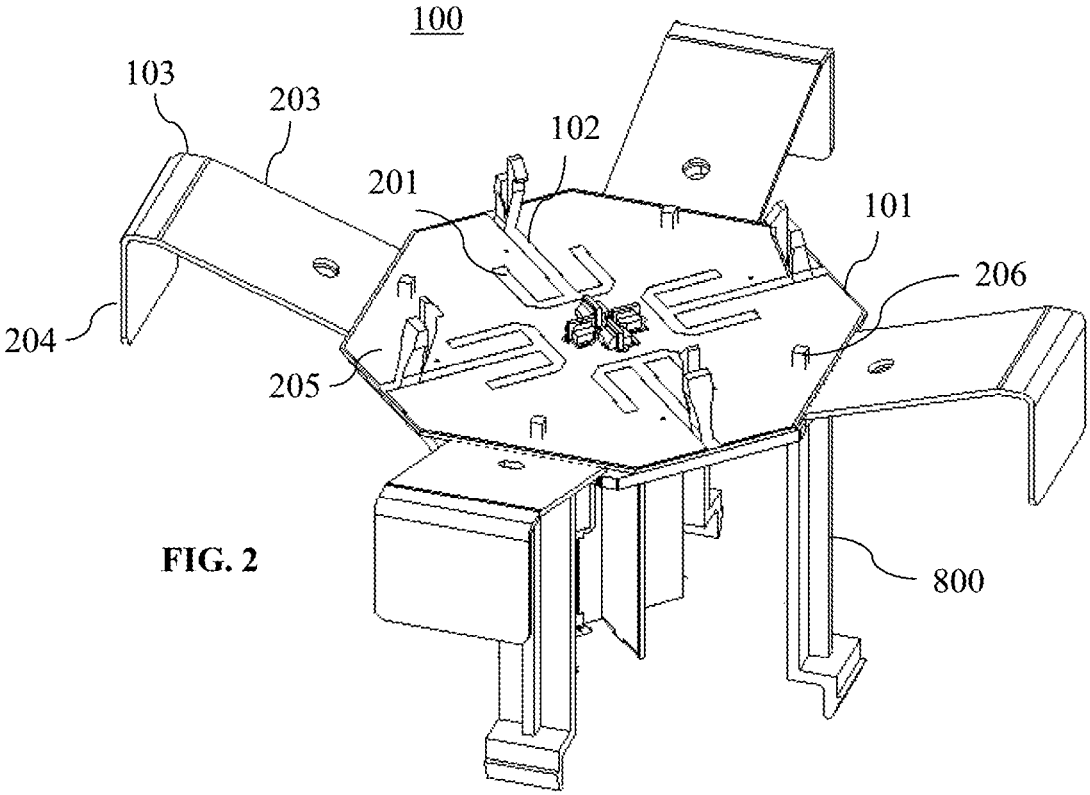
FIG. 2 shows a radiating element according to an embodiment of the present disclosure.

FIG. 2 shows another radiating element 100 according to an embodiment of the present disclosure, which builds on the radiating element 100 shown in FIG. 1. Identical elements in these two FIGS. 1 and 2 are provided with the same reference signs.

In particular, the radiating element 100 of FIG. 2 has the four slots 102 and four dipole arms 103, which are here respectively arranged at 90° intervals each. Further, the angular arrangements of the dipole arms 103 and the slots 102 are here rotated with respect to each other by 45°. Accordingly, the radiating element 100 extends with its dipole arms 103 mainly in two perpendicular directions (referred to as vertical and horizontal directions, respectively), but the polarizations of the radiating element 100 will lie at ±45° to these horizontal and vertical directions. FIG. 2 specifically shows that adjacently arranged slots 102 extend perpendicular to another, and that non-adjacently arranged slots 102 extend in line with another in this radiating element 100. Thus, two in line extending slot pairs are defined.

The two in line extending slot pairs define the two ±45° orthogonal polarizations of the dual-polarized radiating element 100, when it is operated. To this end, the radiating element 100 is fed in operation preferably like a conventional square dipole, whereby the four slots 102 of the feeding arrangement 101 are particularly fed symmetrically 2-by-2.

FIG. 2 also shows that each of the four slots 102 ends in a symmetrically bent, more or less U-shaped slot 201. The purpose of the four slots 201 is to extend the total length of each of the four slots 102, particularly for impedance matching purposes. Since the length of the four slots 102 cannot be extended further to a center portion of the feeding arrangement 101 (due to a lack of space in the middle), they can only be extended to the sides and backwards. In order to thereby maintain the symmetry, the bent slot 201 preferably have the same pattern at both sides of a slot 102. This leads to the symmetrically bent slots 201, preferably the shown U-shaped ones.

The feeding arrangement 101 shown in FIG. 2 comprises a PCB 205, and the four dipole arms 102 are soldered to the PCB 205 through soldering pins 206. The soldering pins 206 cross the PCB 205 from bottom to top. Capacitive coupling between the four dipole arms 102, and to the PCB 205, is possible. However, in this case the coupling area should be dimensioned accordingly, in order to achieve enough coupling. It should also be ensured that the distance between the dipole arms 102 and the PCB 205 is small and stable.

Preferably, the dipole arms 102 do not extend only horizontally and vertically, but—as shown in FIG. 2—also in the third perpendicular dimension, i.e. along a z-axis. In other words, at least a part 203 of each dipole arm 102 preferably extends upwards and/or downwards with respect to the feeding arrangement plane in which the feeding arrangement is arranged 101. In FIG. 2, each dipole arm 103 extends upwards in a part 203. By extending in the z-axis, the dipole arms 102 can be made longer electrically, without increasing their footprint. Furthermore, also a distance to ground can be increased, which reduces the capacitance to ground, and therefore increases the working bandwidth. Most importantly, all these advantages come for free, because the total height of the radiating element 100 does not need to be increased. This is explained below with respect to FIG. 4.

As further shown in FIG. 2, the dipole arms 102 are preferably terminated with flaps 204, which make the dipole arms 102 again electrically longer, without increasing their footprint. Preferably, as shown in FIG. 2, the flaps 204 are bent downwards. However, it is also possible to have upwards or downwards bent flaps 204, and even a bending of flaps 204 back towards the feeding arrangement 101 is possible. Examples of alternative flaps 204 will be provided with respect to other figures further below. Also described further below is an optional support 800 for the radiating element 100.

Figure 3:
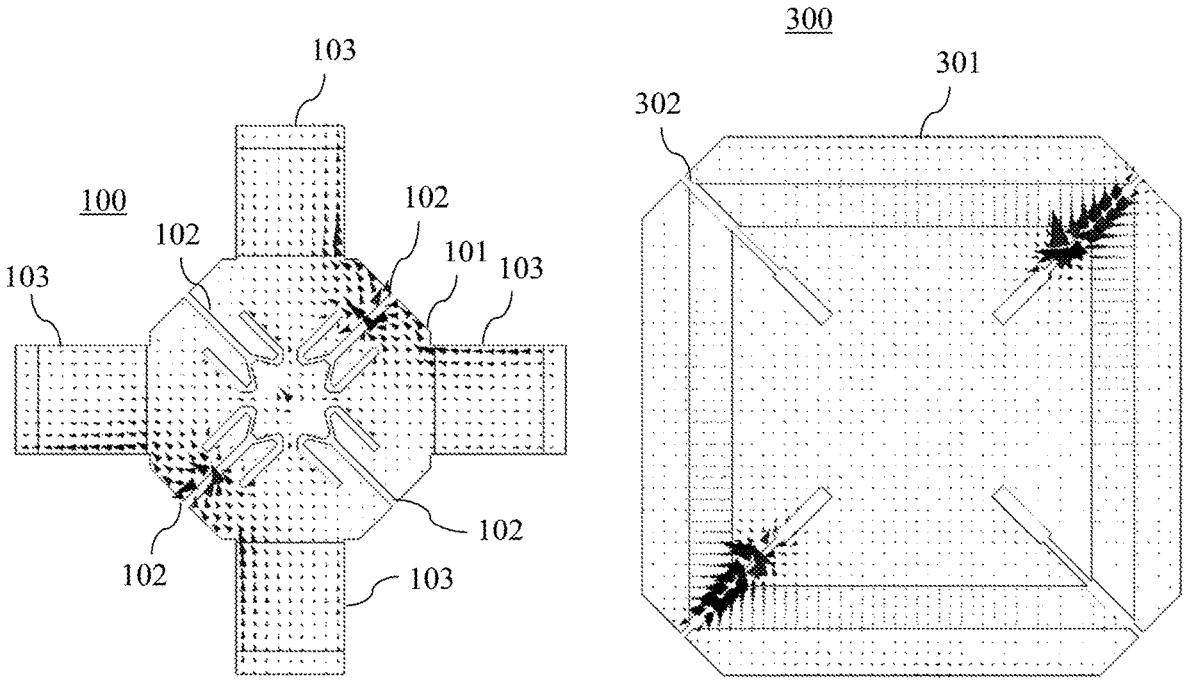
FIG. 3 compares current-density plots of a radiating element according to an embodiment of the present disclosure with a conventional square-shaped radiating element.

FIG. 3 shows a comparison of simulations of a current-density plot in a radiating element 100 (left side) according to FIG. 2, and in a conventional square-shaped radiating element 300 (right side). In the conventional radiating element 300, most of the current is concentrated in slots 302 of a feeding arrangement 301, whereas in the radiating element 100 the dipole is reshaped in such a way, that the current flows horizontally and vertically instead. The horizontal and vertical components of the current are equal, and the combination generates the ±45° polarizations. This advantageously allows to maximize the surface efficiency of the radiating element 100, which means that practically the whole surface of the radiating element 100, i.e. both of the feeding arrangement 101 and the dipole arms 103, contributes to the radiation. The amount of metallic surface is thus optimized. In the conventional square-shaped radiating element 300, there is a big surface amount that practically does not contribute to the radiation. Nevertheless, its presence inside, for instance, a multiband antenna, will create shadows on and interference with other radiating elements working in different, especially in HBs.

For the radiating element 100, the feeding of the slots 102 is, as for a conventional square dipole, but the current distribution corresponds more to a cross dipole. Therefore, advantages of both dipole kinds are combined, and the radiating element 100 has broadband characteristics, but at the same time a very small footprint.

Figure 4:
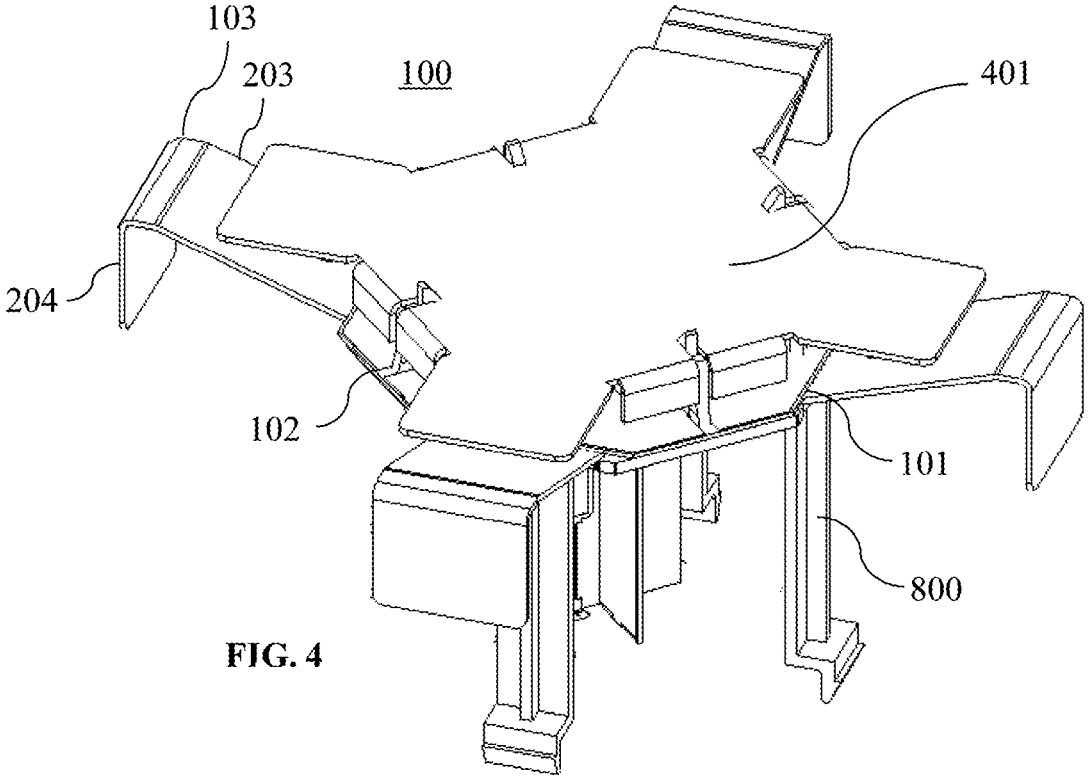
FIG. 4 shows a device according to an embodiment of the present disclosure.

FIG. 4 shows another radiating element 100 according to an embodiment of the present disclosure. The radiating element 100 of FIG. 4 builds on the radiating element 100 shown in FIG. 3. Identical elements in these two FIGS. 3 and 4 are provided with the same reference signs. FIG. 4 shows a radiating element 100 that further comprises a parasitic director 401, which is preferably arranged above the feeding arrangement 101. The parasitic director 401 further helps to achieve the required bandwidth, and at the same time to minimize the dimensions of the radiating element 100.

Figure 5:
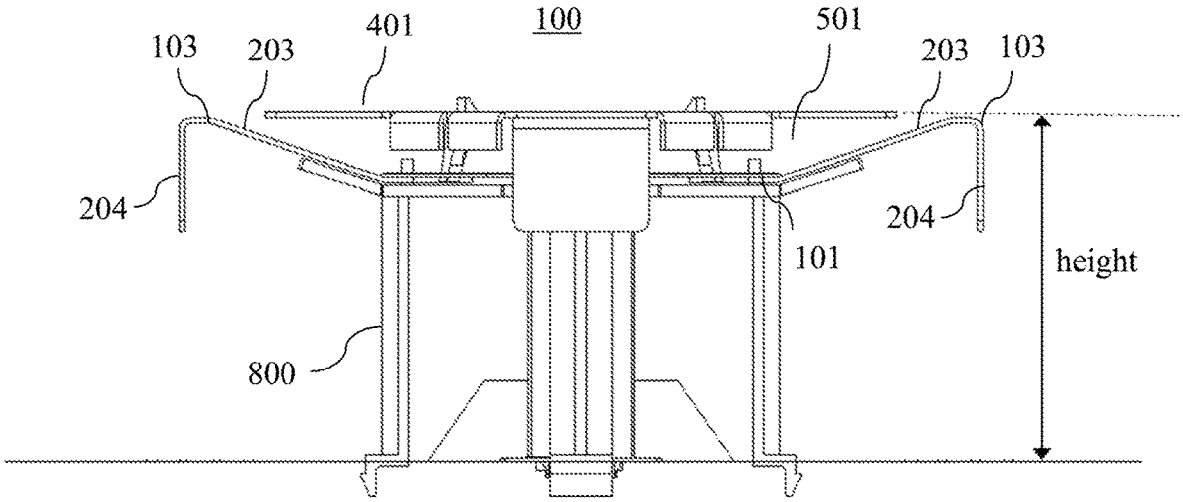
FIG. 5 shows the device of FIG. 4 in a side view.

FIG. 5 shows a side view of the radiating element 100 that is shown in FIG. 4. In FIG. 5, it shows that preferably the parasitic director 401 extends outwards from the feeding arrangement 101 less than each one of the four dipole arms 103. Thus, the parasitic director 401 does not increase the width and length of the radiating element 100 in the horizontal and vertical directions, respectively. Further, additionally or optionally, each dipole arm 103 may comprise, as shown in FIG. 5, an outer part 203 that extends upwards with respect to the feeding arrangement plane. Then, the parasitic director 401 is preferably arranged in a recess 501, which is defined within the four outer parts 203. Thus, the parasitic director 401 does also not increase the height of the radiating element 100. Further, as mentioned above, the dipole arms 103 are extended electrically in length due to the parts 203, however, preferably not above the above plane of the parasitic director 401. The height of the radiating element 100 of FIG. 4 is, for example assuming an operating frequency band of 690-960 megahertz (MHz), about 65 mm. That means, the height of the radiating element 100 is about 0.15λ at 690 MHz, and even below 0.152, at 960 MHz, wherein 2, is the wavelength corresponding to the respective frequencies. That is, it is a low profile radiating element 100.

Figure 6:
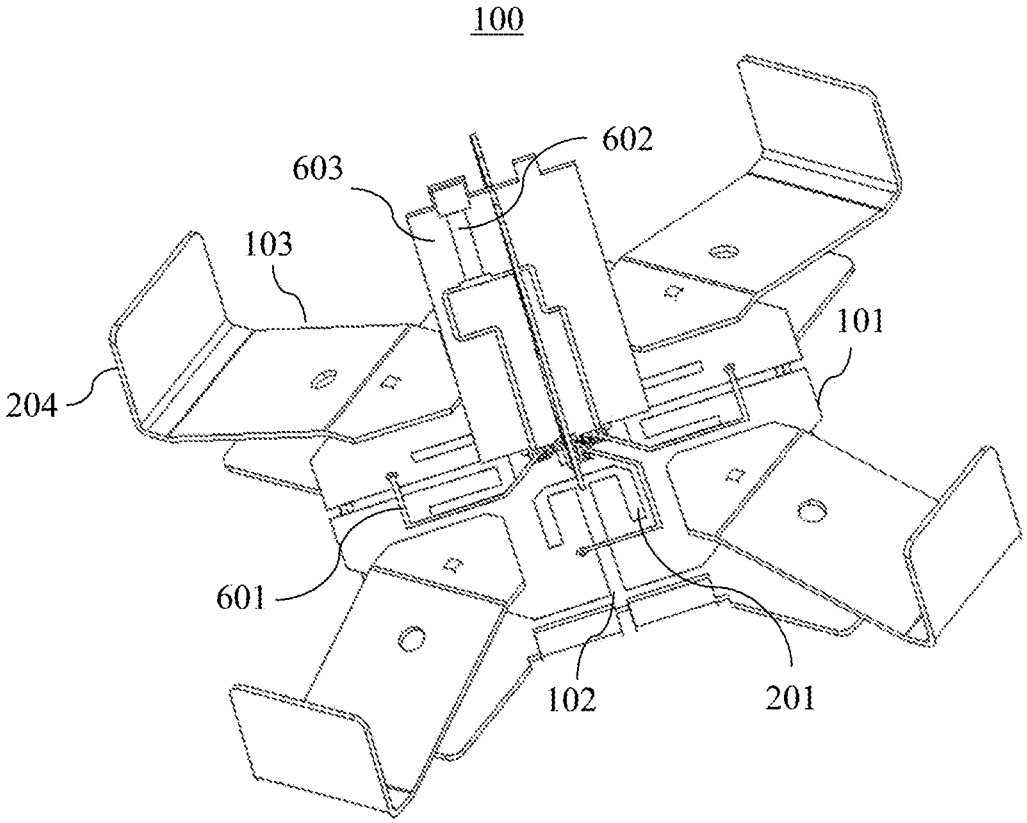
FIG. 6 shows a device according to an embodiment of the present disclosure.

FIG. 6 shows another radiating element 100 according to an embodiment of the present disclosure in a bottom view. Elements shown in FIG. 6 and identical elements in the previous figures, are provided with the same reference signs. The PCB 205 carrying the feeding arrangement 101 and the slots 102, 201 is visualized transparent in FIG. 6, so that the crossings between the (feeding) transmission lines 601 and the slots 102 can be easily seen.

FIG. 6 shows that the feeding arrangement 101 preferably further comprises four transmission lines 601, wherein each transmission line 601 crosses one of the four slots 102. The transmission lines 601 are preferably short-ended microstrip lines. The transmission lines 601 are particularly used for feeding the four slots 102, and are combined, in order to feed two non-adjacent slots 102 in an identical manner. This leads to the dual polarization of the radiating element 100. In FIG. 6, the combination of the four transmission lines 601 into two transmission lines 602 is carried out on a PCB arrangement 603. In particular, this PCB arrangement 603 extends from a bottom surface of the feeding arrangement 101. The PCB arrangement 603 may specifically extend orthogonally from the feeding arrangement 101. Because the four transmission lines 601 are combined into the two transmission lines 602, firstly a feeding signal can be transmitted from the PCB arrangement 603 to, for example, a PCB 205 of the feeding arrangement 101, and secondly the radiating element 100 can be grounded.

For instance, a ground of the PCB arrangement 603 may be connected (e.g. soldered) to a ground of the feeding arrangement 101. The PCB arrangement 603 may also be connected to an additional PCB, which serves, for instance, as a transition between the radiating element 100 and a feeding network. Other implementations, like a direct connection to a phase shifter, or a direct connection to a coaxial cable, are also possible.

Figure 7:
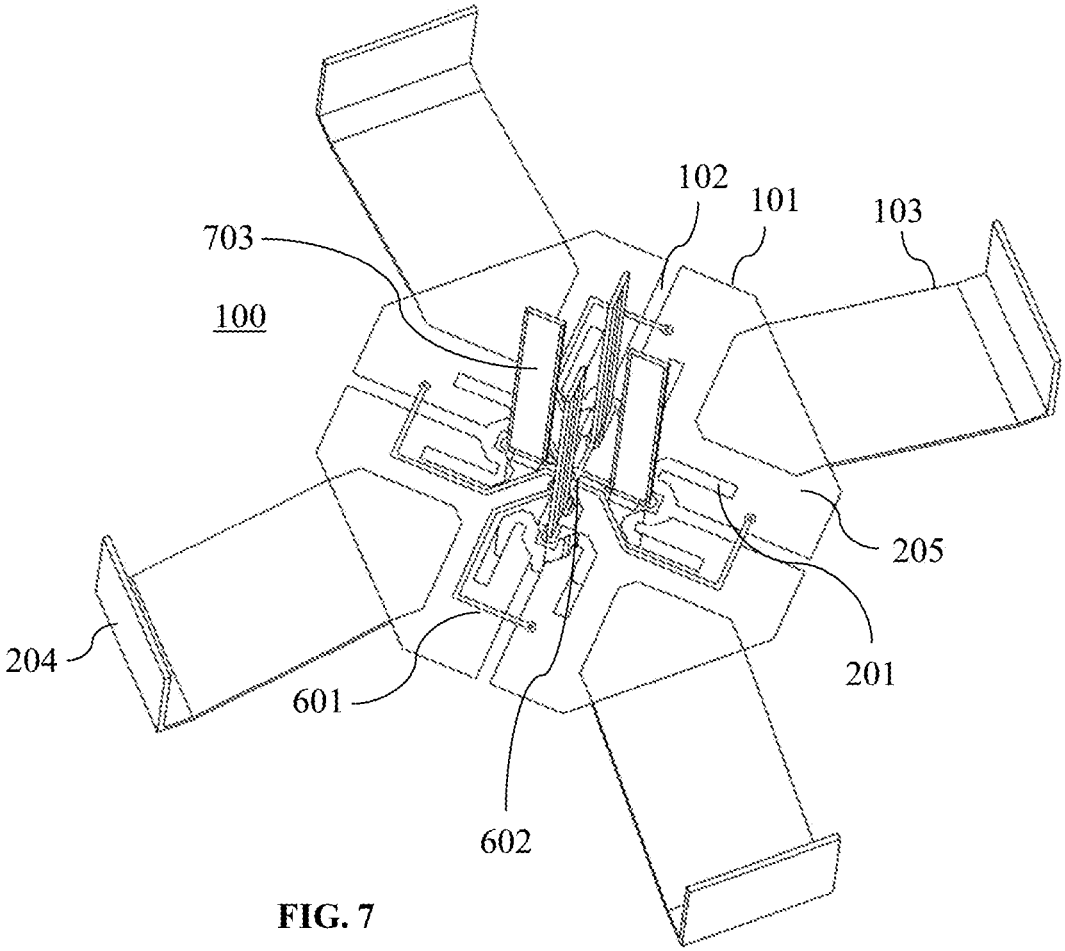
FIG. 7 shows a device according to an embodiment of the present disclosure.

FIG. 7 shows another radiating element 100 according to an embodiment of the present disclosure, in which the transmission lines 601 are combined into transmission lines 702 in a different manner than in FIG. 6. Nevertheless, identical elements in the two FIGS. 6 and 6 are provided with the same reference signs. In particular, in FIG. 7 the combination of the four transmission lines 601 into two transmission lines 702 is carried out on the feeding arrangement 101, particularly, on the PCB 205 of the feeding arrangement 101. Thereby, the number of total soldering points can be reduced, since only two signal paths are present, instead of four. Furthermore, slots in the center of the PCB 205 can be divided into four small slots, which offers advantages in terms of isolation between different frequency bands.

Figure 8:
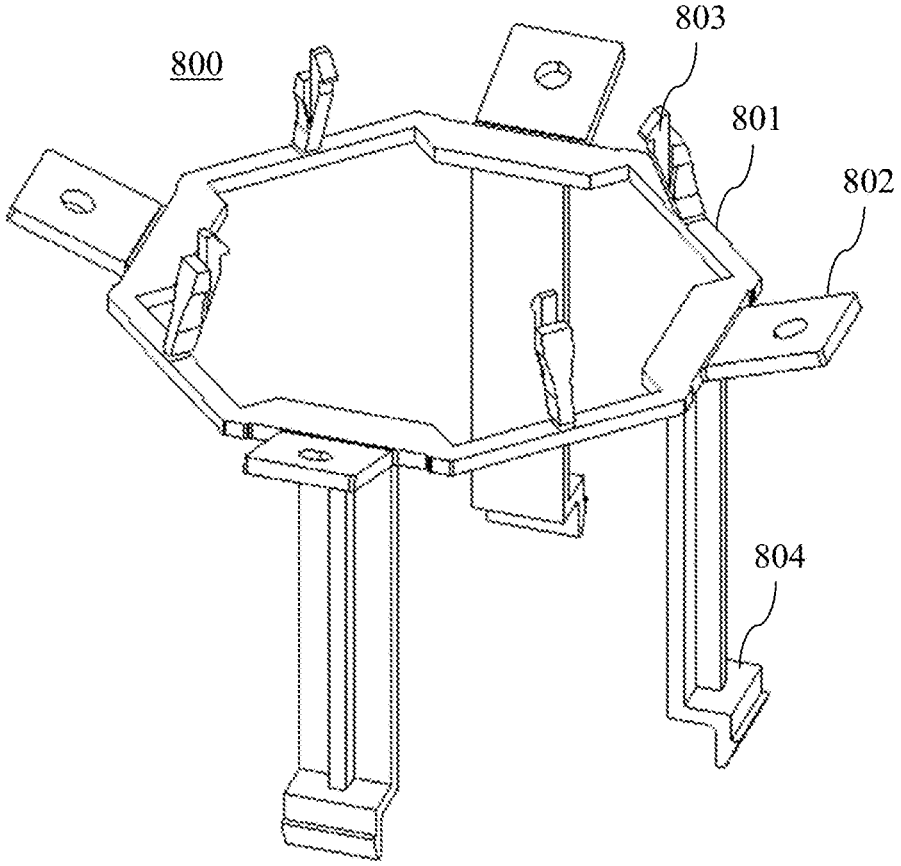
FIG. 8 shows a dielectric support structure for a device according to an embodiment of the present disclosure.

FIG. 8 shows a dielectric support 800, onto which the radiating element 100 according to an embodiment of the present disclosure can be mounted. This is also indicated in the previous figures showing the radiating elements 100. The dielectric support 800 advantageously ensures mechanical stability of the radiating element 100, and ensures that a distance from the radiating element 100 to an antenna reflector, as well as a distance from a parasitic director 401 to the radiating element 100, is stably maintained. The dielectric support 800 may specifically comprise support feet 804, which also define a distance of the radiating element 100 to, for example, a feeding network or to the antenna reflector. Further, the support 800 can include support elements 802, in order to stably support the four dipole arms 102 of the radiating element 100. The support 800 can also comprise attachment means 803, which are configured to hold the feeding arrangement 101, and preferably the parasitic director 401.

Figure 9:
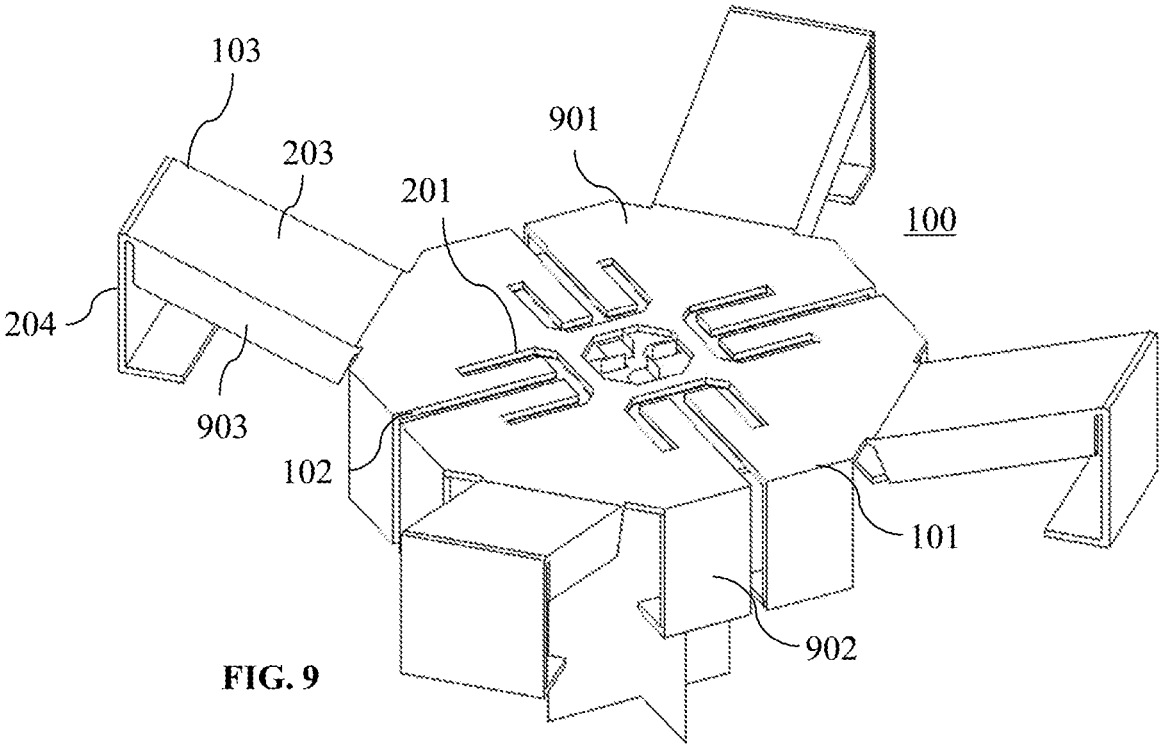
FIG. 9 shows a device according to an embodiment of the present disclosure.

FIG. 9 shows a radiating element 100 according to an embodiment of the present disclosure. Elements in FIG. 9 and identical elements in the previous figures, are provided with the same reference signs. In FIG. 9 the feeding arrangement 101 of the radiating element 100 is made out of one single bent metal sheet together with the dipole arms 103, instead of comprising a PCB 205 and the four dipole arms 103 attached thereto. In particular, the feeding arrangement 101 comprises a metal sheet 901, wherein the four slots 102 are preferably cutouts in the metal sheet 901, and also the four dipole arms 103 are formed by the metal sheet 901. This has, for example, the advantage that the metal sheet 901 can be easily designed with four further flaps 902, which may be arranged in between the four dipole arms 102. The further flaps 902 may be bent upwards or downwards with respect to the feeding arrangement plane. Furthermore, the slots 102 may further extend along the flaps 902. In FIG. 9, the flaps 902 are bent downwards, and furthermore slightly back towards the feeding arrangement 101. Further, as shown in FIG. 9, also the dipole arms 103 can have additional bends, for instance, side flaps 903 for increasing the electrical width of the dipole arm 102. The side flaps 903 may be formed by bending the dipole arms 103 along their extension direction. The slots 102 can be fed by transmission lines on a PCB, e.g. arranged below the metal sheet 901. In a further embodiment the slots 102 may be fed using a suitable cable feed, e.g. arranged below the metal sheet 901.

Figure 10:
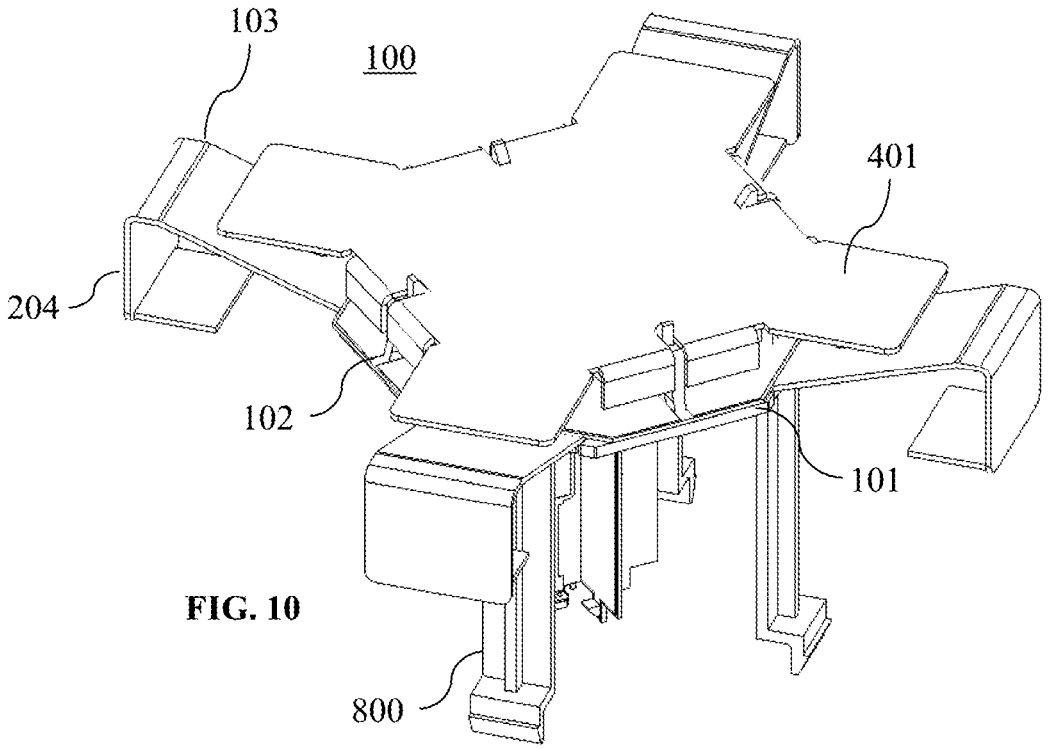
FIG. 10 shows a device according to an embodiment of the present disclosure.

FIG. 10 shows yet another radiating element 100 according to an embodiment of the present disclosure, which builds for instance on the radiating element 100 shown in FIG. 2. Identical elements in these two FIGS. 2 and 10 are provided with the same reference signs. In FIG. 10, the flaps 204 terminating the dipole arms 103 are not only bent downwards, but also back towards the feeding arrangement 101. This provides further electrical length to the dipole arms 103. Further, the optional parasitic capacitor 401 is shown to be arranged above the feeding arrangement 101, and particularly within the extension length of the four dipole arms 103.

Figure 11:
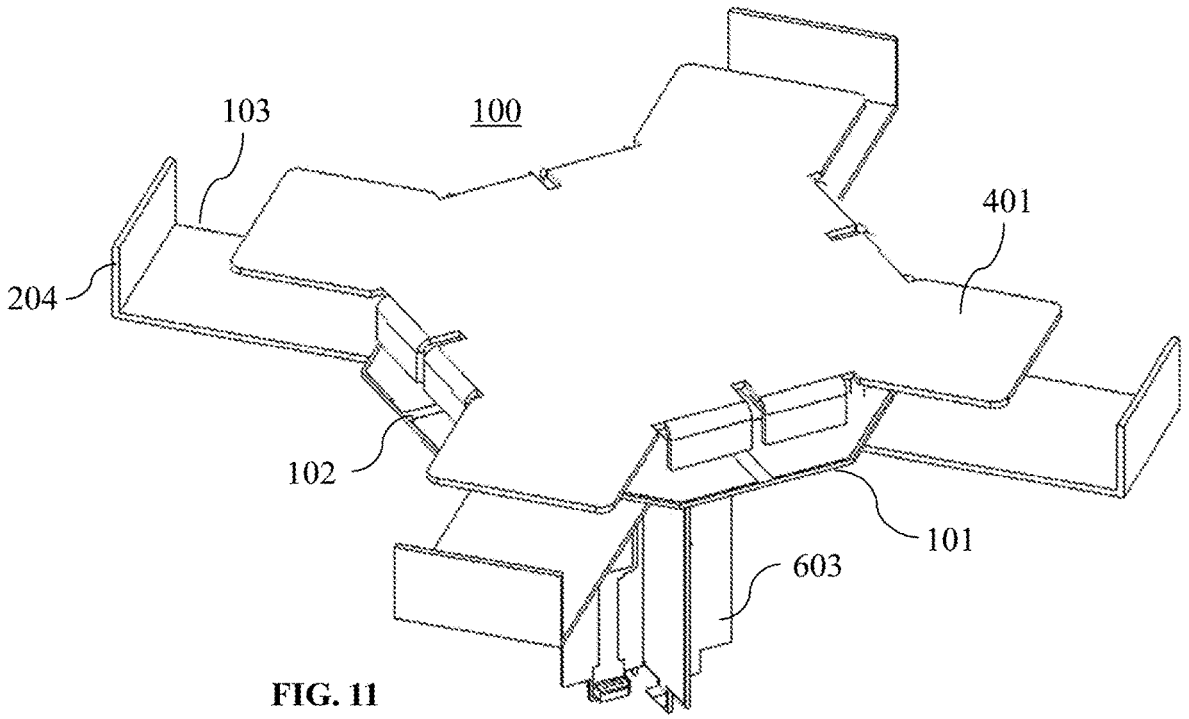
FIG. 11 shows a device according to an embodiment of the present disclosure.

FIG. 11 shows another radiating element 100 according to an embodiment of the present disclosure, which builds on the radiating element 100 shown in FIG. 1. Identical elements in these two FIGS. 1 and 11 are provided with the same reference signs. Here, in FIG. 11, the dipole arms 103 extend outwards from the feeding arrangement 101 and are terminated by upward bent flaps 204, respectively, for increasing their electrical length. Also, the optional PCB arrangement 603 extending from the feeding arrangement 101 is shown. The PCB arrangement 603 may serve also as mechanical support, for instance, instead of the support 800.

Notably, with respect to the above-described radiating elements 100, the decision of whether terminating flaps 204 of the dipole arms 103 are bent upwards or downwards can be decided after a detailed optimization process of the radiating element 100. The decision can, for instance, depend on the arrangement of the radiating element 100 on an antenna, particularly together with other radiating elements arranged side-by-side the radiating element 100.

Figure 12:
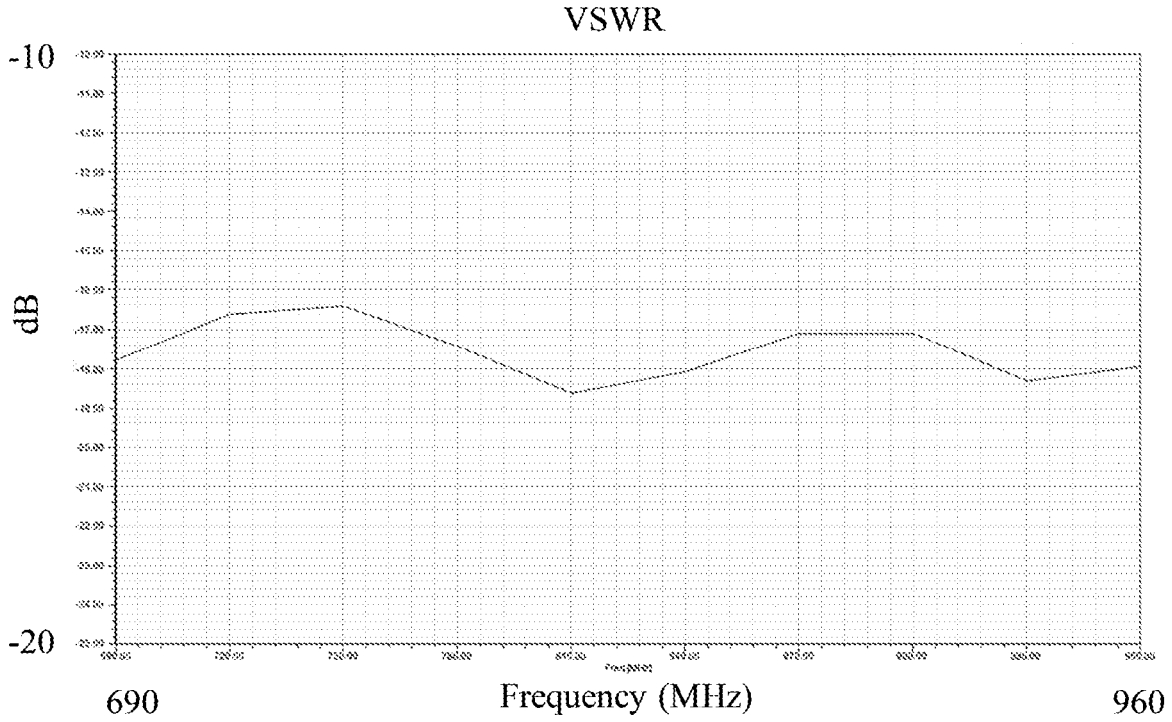
FIG. 12 shows a voltage standing wave ratio (VSWR) of a radiating element according to an embodiment of the present disclosure.
Figure 13:
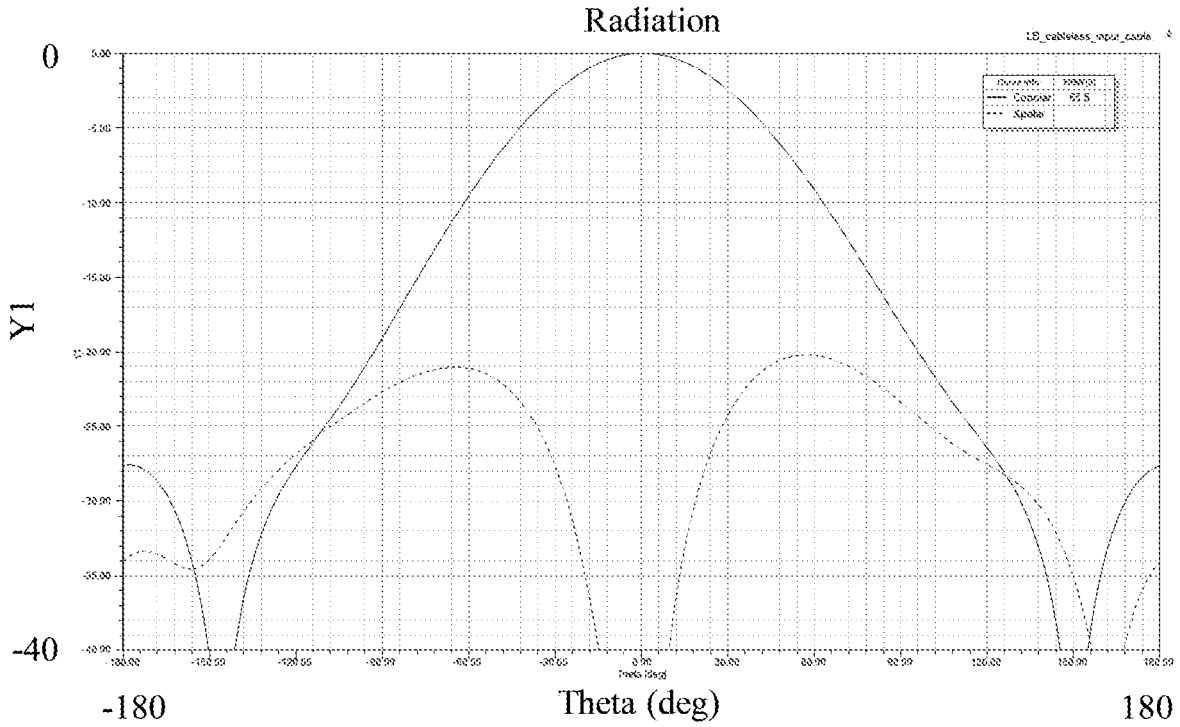
FIG. 13 shows a radiation pattern of a radiating element according to an embodiment of the present disclosure.

FIGS. 12 and 13 show RF performance of the radiating element 100 according to an embodiment of the present disclosure. Specifically, the VSWR and the radiation pattern of the radiating element 100 are shown. FIG. 12 specifically shows that the VSWR is below 16.5 decibel (dB) (1.35:1) from 690-960 MHz. FIG. 13 shows that the radiation pattern is symmetric, the 3 dB beamwidth is around 65° and the Cross-polar discrimination is above 10 dB in the range from +60° to −60°.

Figure 14:
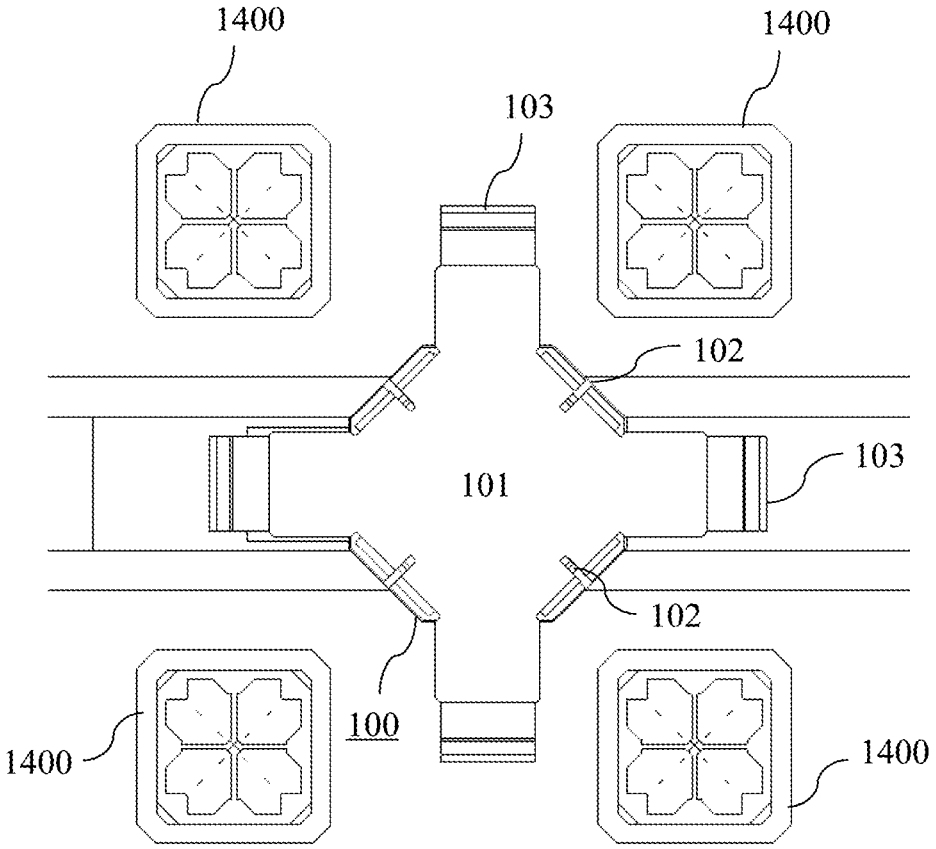
FIG. 14 shows a radiating element according to an embodiment of the present disclosure working in a multiband antenna architecture.

FIG. 14 shows, how the radiating element 100 according to an embodiment of the present disclosure can advantageously be arranged in a multiband antenna architecture. At both sides of the radiating element 100, there are provided other radiating elements 1400, for instance, configured to work in an HB like in HB arrays. Due to the shape of the radiating element 100, a distance between the other radiating elements 1400 on either side of the radiating element 100 can be minimized, namely by arranging the other radiating elements 1400 nested with the dipole arms 103 that extend from the feeding arrangement 101 of the radiating element 100. Therefore, either the dimensions of the multiband antenna architecture can be reduced, or the number of HB arrays within the same dimensions of the architecture can be increased.

Figure 15:
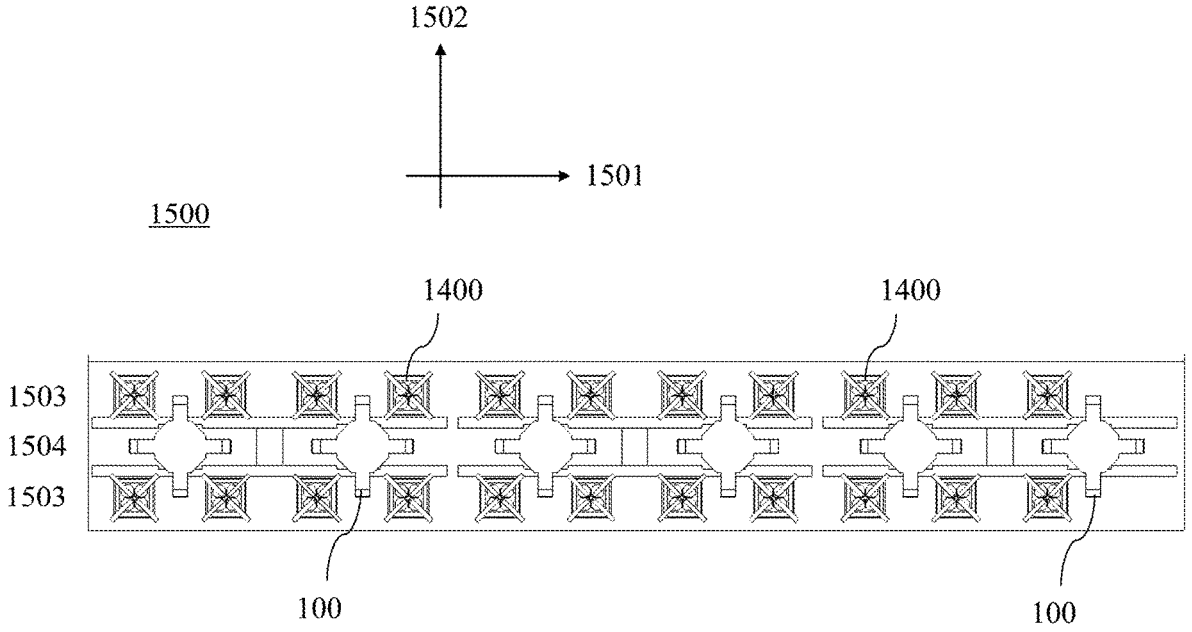
FIG. 15 shows an antenna according to an embodiment of the present disclosure.

FIG. 15 shows in this respect an antenna 1500 according to an embodiment of the present disclosure. The antenna 1500 comprises three columns of radiating elements, each column extending along a longitudinal axis 1501 of the antenna 1500. In particular, the radiating elements 100 are arranged in a first column 1504, which is located in between and side-by-side two second columns 1503 comprising the other radiating elements 1400. Preferably, the second columns 1503 are HB arrays, and the first column 1504 is an LB array. FIG. 15 again shows, how two of the dipole arms 103 of each radiating element 100 extend between two of the other radiating elements 1400 in the HB arrays, i.e. they extend along a lateral axis 1502 of the antenna 1500. The other two dipole arms 103 of each radiating element 100 extend along the longitudinal axis 1501 of the antenna 1500. This allows a very dense packing of the respective HB and LB arrays. However, as also desired, the radiation polarizations defined by the slots 102 of the radiating elements 100 are still ±45° with respect to the longitudinal axis 1501 of the antenna 1500.

In summary, the detailed description and the figures show, that and how the radiating element 100 is made low profile, but is at the same time provided with broadband characteristics. Furthermore, that and how the radiating element 100 has a shape that minimizes interference with other radiating elements 1400 arranged side-by-side in a multiband antenna 1500, and minimizes the width of the antenna 1500.

The present disclosure has been described in conjunction with various embodiments as examples as well as implementations. However, other variations can be understood and effected by those persons skilled in the art and practicing the claimed disclosure, from the studies of the drawings, this disclosure and the independent claims. In the claims as well as in the description the word "comprising" does not exclude other elements or steps and the indefinite article "a" or "an" does not exclude a plurality. A single element or other unit may fulfill the functions of several entities or items recited in the claims. The mere fact that certain measures are recited in the mutual different dependent claims does not indicate that a combination of these measures cannot be used in an advantageous implementation.

What is claimed is:

1. A dual-polarized radiating element, comprising:

a feeding arrangement comprising four slots, which extend from a periphery towards a center of the feeding arrangement and are arranged at regular angular intervals forming a first angular arrangement; and four dipole arms, which extend outwards from the feeding arrangement and are arranged at regular angular intervals forming a second angular arrangement, wherein the second angular arrangement of the four dipole arms is rotated with respect to the first angular arrangement of the four slots, wherein an inner end of each slot of the four slots terminates at a symmetrically bent slot.

2. The dual-polarized radiating element according to claim 1, wherein:

the four slots and the four dipole arms, respectively, are arranged at 90 degrees (°) intervals; and the second angular arrangement of the four dipole arms is rotated by 45° with respect to the first angular arrangement of the four slots.

3. The dual-polarized radiating element according to claim 1, wherein:

adjacently arranged slots extend perpendicular to another;

non-adjacently arranged slots extend in-line with another; and the two in-line extending slot pairs define two orthogonal polarizations of the dual-polarized radiating element.

4. The dual-polarized radiating element according to claim 1, wherein at least a part of each dipole arm extends at least one of: upwards, and downwards, with respect to a plane defined by the feeding arrangement.

5. The dual-polarized radiating element according to claim 1, wherein an outer end of each dipole arm of the four dipole arms terminates with a flap, and wherein the flap is bent downwards or upwards with respect to the feeding arrangement plane, and wherein the flap is optionally bent back towards the feeding arrangement.

6. The dual-polarized radiating element according to claim 1, further comprising a parasitic director arranged above the feeding arrangement.

7. The dual-polarized radiating element according to claim 6, wherein at least one of:

the parasitic director extends outwards from the feeding arrangement by a distance that is less than a distance by which each of the four dipole arms extends outwards from the feeding arrangement; and each dipole arm comprises an outer part extending upwards with respect to a plane defined by the feeding arrangement, and the parasitic director is arranged in a recess defined within the outer part of each of the four dipole arms.

8. The dual-polarized radiating element according to claim 1, wherein:

the feeding arrangement comprises four transmission lines; and each transmission line of the four transmission lines crosses one of the four slots.

9. The dual-polarized radiating element according to claim 8, wherein two transmission lines of the four transmission lines cross non-adjacent slots and are combined into one transmission line.

10. The dual-polarized radiating element according to claim 9, wherein:

the feeding arrangement comprises a printed circuit board (PCB), on which PCB the four transmission lines are combined into the two transmission lines; or the radiating element comprises a PCB arrangement extending from a bottom surface of the feeding arrangement, on which PCB arrangement the four transmission lines are combined into the two transmission lines.

11. The dual-polarized radiating element according to claim 1, wherein:

the feeding arrangement comprises a PCB;

the four slots are arranged on the PCB; and the four dipole arms are connected are connected to the PCB.

12. The dual-polarized radiating element according to claim 1, wherein:

the feeding arrangement comprises a metal sheet;

the four slots are cut outs in the metal sheet; and the four dipole arms are formed by the metal sheet.

13. The dual-polarized radiating element according to claim 12, wherein the metal sheet comprises four flaps, which are bent upwards or downwards with respect to a plane defined by the feeding arrangement and are arranged in between the four dipole arms, respectively.

14. The dual-polarized radiating element according to claim 1, wherein the symmetrically bent slot is a U-shaped slot.

15. An antenna, comprising at least one dual-polarized radiating element each dual-polarized radiating element, comprising:

a feeding arrangement comprising four slots, which extend from a periphery towards a center of the feeding arrangement and are arranged at regular angular intervals forming a first angular arrangement; and four dipole arms, which extend outwards from the feeding arrangement and are arranged at regular angular intervals forming a second angular arrangement, wherein the second angular arrangement of the four dipole arms is rotated with respect to the first angular arrangement of the four slots, wherein an inner end of each slot of the four slots terminates at a symmetrically bent slot, and wherein:

two dipole arms of the at least one dual-polarized radiating element extend along a longitudinal axis of the antenna; and two dipole arms of the at least one dual-polarized radiating element extend along a lateral axis of the antenna.

16. The antenna according to claim 15, wherein each slot of the at least one dual-polarized radiating element extends at an angle of 45 degrees (°) with respect to the longitudinal axis of the antenna.

17. The antenna according to claim 15, further comprising:

a plurality of dual-polarized radiating elements arranged along the longitudinal axis of the antenna in a first column; and a plurality of other radiating elements arranged along the longitudinal axis of the antenna in two second columns disposed side-by-side the first column.

18. The antenna according to claim 17, wherein:

the antenna is configured for multiband operation;

the plurality of dual-polarized radiating elements are configured to radiate in a lower frequency band; and the plurality of other radiating elements are configured to radiate in a higher frequency band.

19. The antenna according to claim 17, wherein, for each of the plurality of dual-polarized radiating elements, each of the two dipole arms extending along the lateral axis of the antenna extends between two of the other radiating elements in each of the two second columns.

* * * * *